US007644918B2

(12) United States Patent
Peulen

(10) Patent No.: US 7,644,918 B2
(45) Date of Patent: Jan. 12, 2010

(54) SHEET DISCHARGE SYSTEM

(75) Inventor: Johannes E. P. Peulen, Belfeld (NL)

(73) Assignee: Océ-Technologies B.V., Venlo (NL)

( * ) Notice: Subject to any disclaimer, the term of this patent is extended or adjusted under 35 U.S.C. 154(b) by 382 days.

(21) Appl. No.: 11/284,841

(22) Filed: Nov. 23, 2005

(65) Prior Publication Data

US 2006/0181017 A1 Aug. 17, 2006

(30) Foreign Application Priority Data

Nov. 25, 2004 (EP) ..... 04106079

(51) Int. Cl.
*B65H 31/00* (2006.01)

(52) U.S. Cl. ..... 271/207; 271/198

(58) Field of Classification Search ..... 271/189, 271/191, 207, 198; 270/58.12, 58.16, 58.17
See application file for complete search history.

(56) References Cited

U.S. PATENT DOCUMENTS

| | | | | |
|---|---|---|---|---|
| 3,046,008 | A | 7/1962 | Velvel | |
| 4,350,333 | A * | 9/1982 | Landa | 271/217 |
| 4,883,265 | A * | 11/1989 | Iida et al. | 271/220 |
| 4,927,131 | A * | 5/1990 | Hashimoto et al. | 271/215 |
| 5,005,821 | A * | 4/1991 | Burger | 271/198 |
| 5,021,837 | A * | 6/1991 | Uto et al. | 399/405 |
| 5,215,300 | A * | 6/1993 | Hiroi et al. | 271/176 |
| 5,289,251 | A * | 2/1994 | Mandel et al. | 399/407 |
| 5,473,420 | A * | 12/1995 | Rizzolo et al. | 399/107 |
| 5,765,824 | A * | 6/1998 | Kawano et al. | 270/58.11 |
| 5,957,652 | A * | 9/1999 | Mimura et al. | 414/790.4 |
| 6,196,542 | B1 * | 3/2001 | Allmendinger | 271/189 |
| 6,220,592 | B1 * | 4/2001 | Watanabe et al. | 271/241 |
| 6,264,194 | B1 * | 7/2001 | Hayashi et al. | 271/220 |
| 6,283,470 | B1 * | 9/2001 | Hirai | 271/189 |
| 6,352,253 | B1 | 3/2002 | Hayakawa et al. | |
| 6,631,902 | B1 * | 10/2003 | Beauchamp | 271/219 |
| 6,666,444 | B1 * | 12/2003 | Paoli | 270/58.11 |
| 6,848,688 | B1 * | 2/2005 | Ruthenberg et al. | 271/221 |
| 6,986,511 | B2 * | 1/2006 | Yamada et al. | 271/294 |
| 7,172,186 | B2 * | 2/2007 | Saito et al. | 270/58.08 |
| 7,407,160 | B2 * | 8/2008 | Peulen et al. | 271/207 |
| 2004/0251608 | A1 * | 12/2004 | Saito et al. | 271/220 |
| 2006/0181019 | A1 * | 8/2006 | Peulen et al. | 271/314 |

FOREIGN PATENT DOCUMENTS

| | | | |
|---|---|---|---|
| DE | 201 12 511 | U1 | 7/2001 |
| EP | 0 693 713 | A2 | 1/1996 |
| EP | 1 160 099 | A2 | 12/2001 |
| GB | 2 285 968 | A | 1/1994 |

* cited by examiner

*Primary Examiner*—Patrick H MacKey
*Assistant Examiner*—Michael C McCullough
(74) *Attorney, Agent, or Firm*—Birch, Stewart, Kolasch & Birch LLP

(57) ABSTRACT

A discharge system for printed media sheets which includes a tray having a surface for supporting the media sheets; and rotating transport elements forming a discharge nip for discharging the sheets onto the tray, wherein at least one driven transport belt is arranged to engage a trailing edge of the sheet that has left the discharge nip and to exert a driving force towards the tray surface.

6 Claims, 2 Drawing Sheets

SHEET DISCHARGE SYSTEM

BACKGROUND OF THE INVENTION

The present invention relates to a discharge system for printed media sheets, including: a tray having a surface for supporting the media sheets; and rotating transport elements forming a discharge nip for discharging the sheets onto the tray.

In printers and copiers, printed media sheets are frequently collected on one or more trays. The media sheets may be supplied, for example, from a stack of cut sheets, or may be continuously supplied from a reel and then cut into sheets. When the media sheets are supplied from a reel, they are often slightly curled. This effect becomes even more pronounced when the end of the reel is reached and the radius of curvature of the reel becomes smaller. Also, for example, when the media sheets are supplied from a stack of cut sheets, they may become curled during the printing process.

When the printed media sheets are collected on the tray, curled edges of deposited sheets may prevent subsequent sheets from being properly stacked and collected on the tray. For example, when a sheet on the tray is curled upwards at its leading and trailing edges, the space on the tray is used inefficiently, leading to a reduced capacity of the tray. Moreover, curled edges of previously collected sheets might block the discharge nip.

SUMMARY OF THE INVENTION

It is an object of the present invention to provide a discharge system that ensures that upwardly curled media sheets are neatly collected on a tray while avoiding the problems mentioned above. It is also an object of the present invention to provide a printer containing such a discharge system.

According to the present invention, this object is achieved by a discharge system of the type indicated above, wherein at least one driven transport belt is arranged to engage a trailing edge of the sheet that has left the discharge nip and to exert a driving force towards the tray surface.

If a sheet curls upwards after it has left the discharge nip, the trailing edge will engage the transport belt and will be frictionally entrained towards the tray surface. Thus, a subsequent sheet may be neatly deposited on the previous sheet. In this way, a relatively large number of printed media sheets can be neatly stacked on the tray surface, and the discharge nip will not become blocked by the trailing edges of upwardly curled sheets. The transport belt may have two functions: pushing down the trailing edges of printed media sheets, and assisting in transporting the sheets onto the tray.

The tray surface may slope downward towards the discharge nip. In this case, when the sheet has been discharged from the discharge nip, it falls onto the tray and may slide down the slope of the tray until its trailing edge is caught either by the transport belt or, if the sheet is not curled, by a stop formed at the lower edge of the tray.

The tray system of the present invention is especially advantageous when media sheets are supplied from a reel and a media transport line is arranged such that a surface of a sheet which has been outwardly oriented on the reel comes to lie towards the tray surface. The media sheets may be, for example, continuously supplied from the reel and then cut into sheets.

In a preferred embodiment, the transport belt forms one of the transport elements defining the discharge nip. For example, the transport belt is mounted on two pulleys, and the second transport element may be another roller that is positioned adjacent to one of the pulleys. Thus, the sheet that is to be discharged is held between said roller and the transport belt. For example, the transport belt may be positioned below the roller. It the sheet is guided to the discharge nip along a curved guide plate making approximately a half turn around the roller and the drive belt so as to reverse the sheet before it is discharged, then the transport belt may also help to guide the leading edge of the sheet to the discharge nip, especially when the sheet is strongly curled.

The number of transport belts may be larger than one and will be adapted to the maximum width of the sheets to be discharged. Also, there may be more than one further roller, these rollers rotating round a common axis.

BRIEF DESCRIPTION OF THE DRAWINGS

A preferred embodiment of the present invention will now be described in conjunction with the drawings in which.

DETAILED DESCRIPTION OF THE INVENTION

Figure 1:
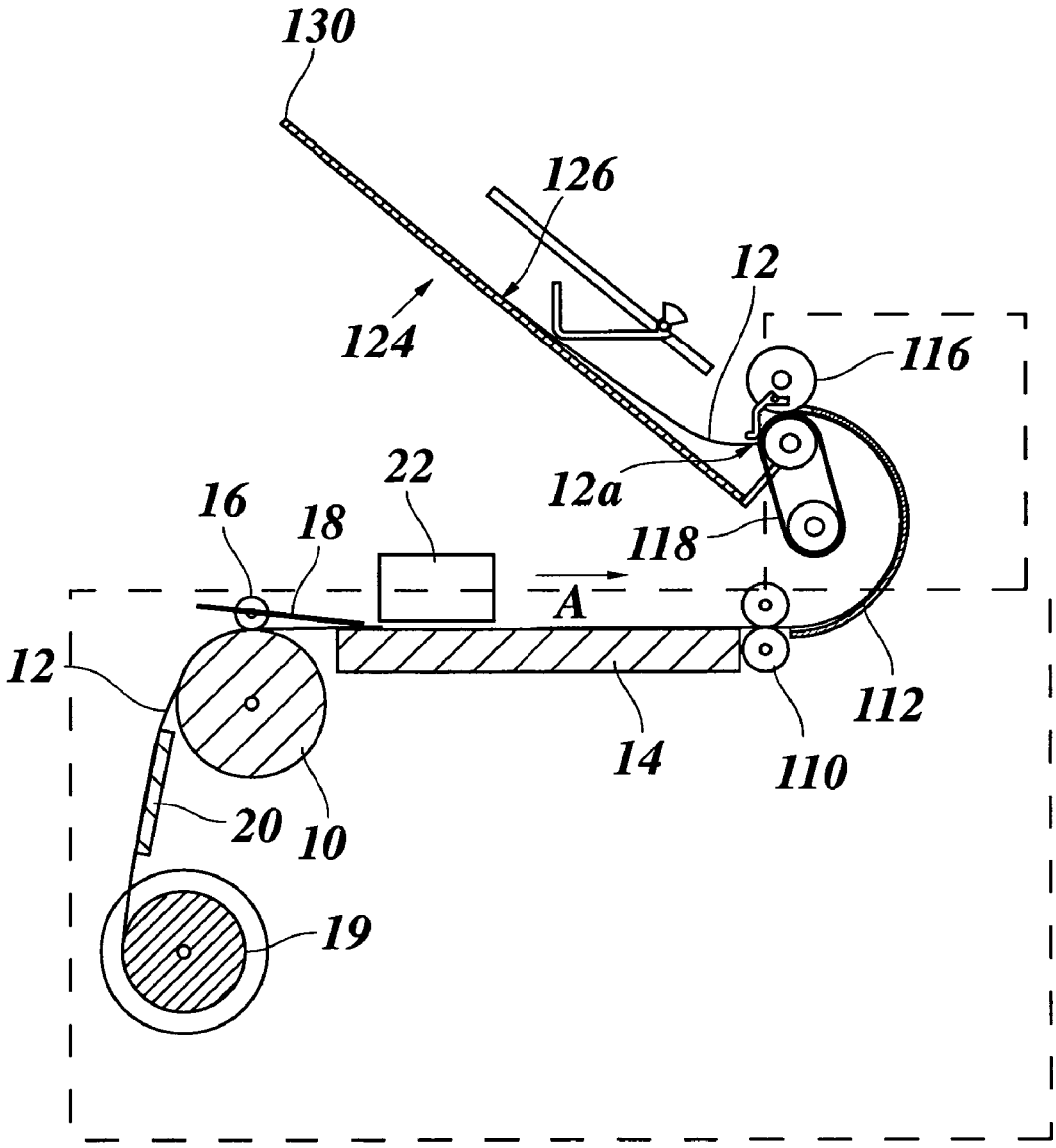
FIG. 1 is a schematic partial cross-sectional view of a printer.

As is shown in FIG. 1, an ink jet printer comprises a platen 10 which is intermittently driven to rotate in order to advance a sheet 12, e.g. a sheet of paper, in a direction indicated by an arrow A over the top surface of a sheet support plate 14. A number of transport rollers 16 are rotatably supported in a cover plate 18 and form a transport nip with the platen 10 so that the sheet 12, which is supplied from a reel 19 via a guide plate 20, is paid out through a gap formed between an edge of the cover plate 18 and the surface of the sheet support plate 14.

A carriage 22 which includes a number of ink jet print heads (not shown) is mounted above the sheet support plate 14 so as to reciprocate in a direction that is perpendicular to the plane of the drawing across the sheet 12. In each pass of the carriage 22, a number of pixel lines are printed on the sheet 12 by means of the print heads which eject droplets of ink onto the sheet in accordance with image information supplied to the print heads. For the sake of simplicity, guide and drive means for the carriage 22, ink supply lines and data supply lines for the print heads, and the like, have not been shown in the drawing.

Figure 2:
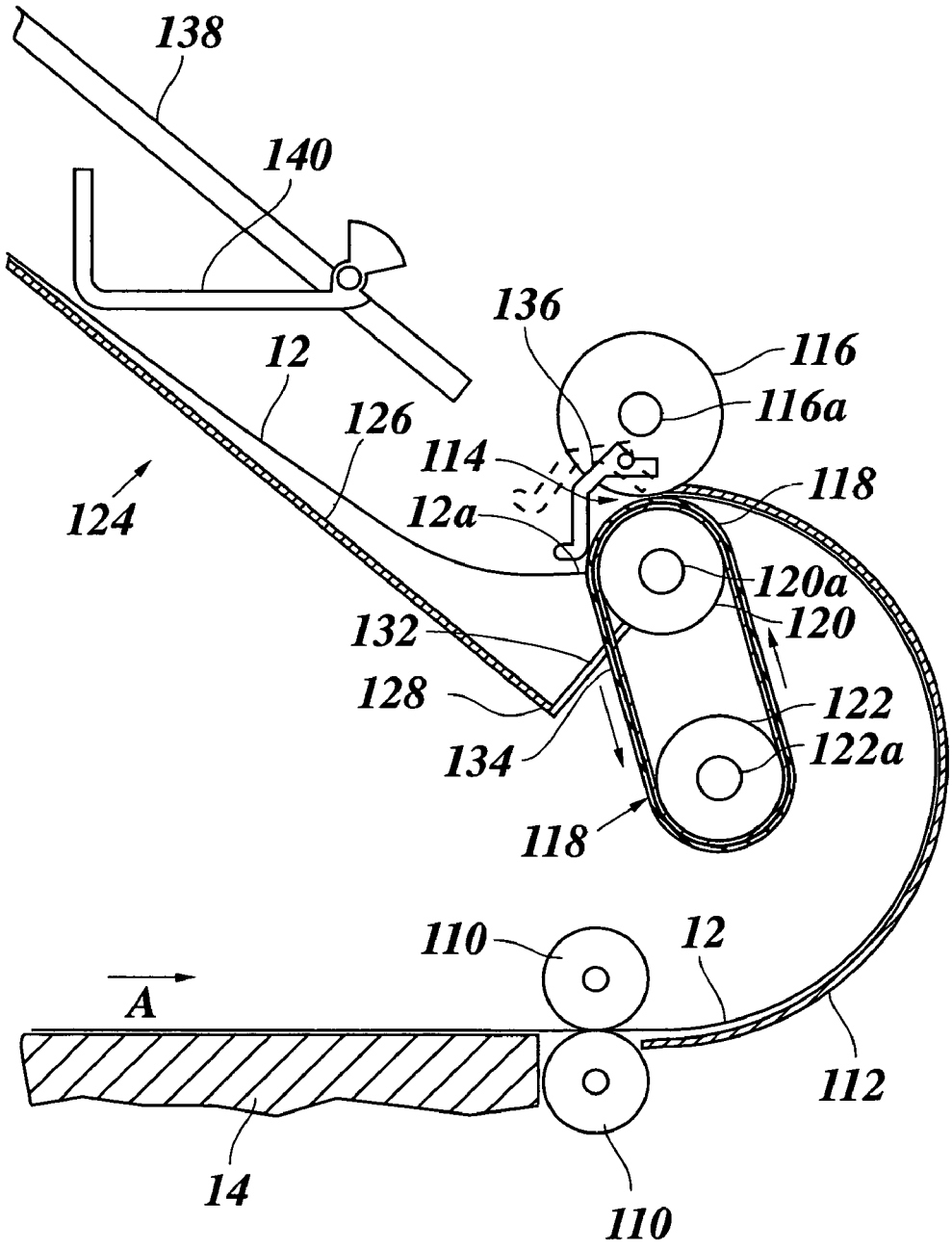
FIG. 2 shows details of a sheet discharge system of the printer shown in FIG. 1.

As is shown in FIG. 1 and, in a more detailed view, in FIG. 2, the printed sheet 12 is further transported by transport means formed by rollers 110 defining a transport nip that is positioned in the media transport line behind the sheet support plate 14. The rollers 110 advance the sheet along a curved guide member 112 that turns the sheet upside down and reverses the transport direction of the sheet 12.

The sheet 12 is then fed to a discharge nip 114 formed between a plurality of discharge rollers 116 and a plurality of rubber-coated transport belts 118 which are each passed around a pair of pulleys 120 and 122. The direction of movement of the transport belts 118 is indicated by arrows. The discharge rollers 116 are mounted on a common axle **116*a*, and the pulleys 120 and 122 are also mounted on common axles 120*a* and 122*a*, respectively. While the sheet 12 is guided by the guide member 112 around the pulleys 122, the transport belts 118 may also serve to guide a leading edge of the sheet 12 towards the discharge nip 114 in the case where the leading edge of the sheet 12 bends down towards the transport belts 118**.

From the discharge nip 114, the sheet 12 is discharged onto a tray 124. The tray 124 has a top surface 126 for supporting the media sheets. The top surface 126 rises from a lower edge 128 near the discharge nip 114 and the transport belts 118 to an upper edge 130 (FIG. 1). At the lower edge 128, finger-like stops 132 rise perpendicularly to the tray surface 126 towards the transport belts 118. In a direction perpendicular to the plane of the drawing in FIG. 2, the transport belts 118 and the stops 132 are arranged at intervals, and in a side view of FIG. 2, the stops 132 intersect a straight section 134 of the transport belt 118 which passes through gaps between the stops. The straight section 134 is inclined by, for example, approximately 55° with respect to the stops 132, and moves towards the tray surface 126.

Beginning at the discharge nip 114 and ending at the line where the transport belts 118 intersect the stops 132, the sections 134 of the transport belts 118 form guide and drive means for the trailing edge 12*a* of a sheet 12 that has just left the discharge nip. The belt section 134 first pushes the sheet 12 onto the tray 124 and then comes into frictional engagement with the trailing edge 12*a* of the sheet and pushes it towards the tray surface 126 and towards the lower edge 128 of the tray 124. Thus, the sheet 12 is neatly deposited on the tray 124, even if its trailing edge 12*a* is curled upwards as indicated in FIG. 2.

Like the platen 10, the rollers 110 and the transport belts 118 are intermittently driven in order to advance the sheet 12 step-wise. A discharge sensor 136 is arranged near the discharge nip 114 to indicate when the trailing edge 12*a* of the sheet 12 has been discharged from the discharge nip 114 and has been guided towards the tray surface 126. The discharge sensor 136 is of conventional design and comprises an arm that is pivotable about an axis.

A top frame member 138 of the tray 124 carries a tray-full sensor 140 which is also of a conventional design comprising an arm that is pivotably mounted on the frame member 138.

By means of the transport belts 118, the printed sheets 12 are neatly deposited on the tray 124. Thus, the upwardly curled edge 12*a* of the sheet 12 will not interfere with the discharge sensor 136, and the tray-full sensor 140 will allow the full capacity use of the tray 124.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A discharge system for printed media sheets comprising a tray having a surface for supporting the media sheets; and rotating transport elements forming a discharge nip for discharging the sheets onto the tray, wherein at least one driven transport belt is arranged to engage a trailing edge of the sheets that have left the discharge nip and to exert a driving force towards the tray surface, wherein the discharge system contains a curved guide plate for guiding the sheets to the discharge nip, said guide plate passing about a one-half turn around two pulleys around which the transport belt is passed.

2. The discharge system of claim 1, wherein the transport belt forms one of the transport elements defining the discharge nip.

3. The discharge system of claim 1, wherein a stop extends perpendicular to the tray surface from an edge of the tray adjacent to the discharge nip, and the transport belt is laterally offset from the stop and has a belt section intersecting a cross-section of the stop.

4. The discharge system of claim 1, wherein the tray is inclined and slopes down towards the discharge nip.

5. A printer containing a sheet discharge system according to claim 1.

6. The discharge system of claim 1, wherein the rotating transfer elements forming the discharge nip comprise a discharge roller disposed on one side of the media sheets and one end of the transport belt, which is conveyed around said two pulleys, disposed on the other side of the media sheets, the other end of the transport belt being positioned relative to the curved guide plate so that in the event of a collapse of a leading edge of a media sheet, said collapsed edge would be effectively conveyed by the transport belt to the discharge nip.

* * * * *